US005799581A

United States Patent [19]

Taylor

[11] Patent Number: 5,799,581

[45] Date of Patent: Sep. 1, 1998

[54] ARTICULATING SUSPENSION SYSTEM FOR A BRIDGE OF AN OVERHEAD BRIDGE CRANE

[75] Inventor: Michael K. Taylor, Farmington, N.Y.

[73] Assignee: Gorbel, Inc., Fishers, N.Y.

[21] Appl. No.: 713,617

[22] Filed: Sep. 13, 1996

[51] Int. Cl.[6] ..... E01B 25/00

[52] U.S. Cl. ..... 104/111; 212/312; 105/163.1

[58] Field of Search ..... 104/111, 98; 105/163.1, 105/163.2; 212/171, 312, 314, 318, 73, 75

[56] References Cited

U.S. PATENT DOCUMENTS

| | | | |
|---|---|---|---|
| 660,289 | 10/1900 | Bryan . | |
| 1,752,026 | 3/1930 | Phillips | 212/312 |
| 1,828,603 | 10/1931 | Holley . | |
| 1,871,519 | 8/1932 | Hawley . | |
| 2,156,827 | 5/1939 | Wehr | 104/111 |
| 2,845,877 | 8/1958 | Richter | 104/98 |
| 2,928,356 | 3/1960 | Tredwell . | |
| 2,978,992 | 4/1961 | Wason . | |
| 3,155,051 | 11/1964 | Sherburne . | |
| 3,267,893 | 8/1966 | Sheehan, Sr. . | |
| 3,459,311 | 8/1969 | Averbukh et al. . | |
| 3,888,185 | 6/1975 | Walsh . | |
| 4,122,778 | 10/1978 | Di Rosa . | |
| 4,228,738 | 10/1980 | Forshee . | |
| 4,289,076 | 9/1981 | Miller . | |
| 4,768,442 | 9/1988 | Miller . | |
| 5,158,021 | 10/1992 | Matsui et al. . | |

FOREIGN PATENT DOCUMENTS

| | | | |
|---|---|---|---|
| 68961 | 9/1969 | Germany | 213/312 |
| 1151941 | 5/1969 | United Kingdom | 212/312 |

*Primary Examiner*—Mark T. Le
*Attorney, Agent, or Firm*—Eugene Stephens & Associates

[57] ABSTRACT

An articulating suspension for the bridge of an overhead bridge crane allows the bridge to be skewed from perpendicular to the parallel runs that support the bridge. The runs are allowed to pivot toward each other on pivot axes above and parallel with each run. End trucks that support end regions of the bridge from each run are interconnected with the bridge via suspension hangers. These are suspended on end truck pivots that are parallel with the runs and include thrust bearings that allow the bridge to skew. The bridge is suspended from the hangers on a pivot axis above and parallel with the bridge. The arrangement allows the necessary freedom of movements for skewing the bridge without making the crane wobbly or unstable. The arrangement of pivot pins and thrust bearings also is rugged and durable and requires little maintenance.

19 Claims, 3 Drawing Sheets

ARTICULATING SUSPENSION SYSTEM FOR A BRIDGE OF AN OVERHEAD BRIDGE CRANE

TECHNICAL FIELD

Articulating suspension for overhead bridge crane.

BACKGROUND

Manual effort moves the bridges and suspended loads of bridge cranes, and minimizing manual effort is desirable. One way to accomplish this is to allow a bridge of a bridge crane to be skewed from perpendicular to its runs so that a load near one end of the bridge can be moved a small distance without moving the entire bridge. Bridge crane suspensions have been made to accommodate skewing of the bridge by using ball joints that allow the runs to be pivoted inward toward each other and allow the bridge to be angled from perpendicular to the end trucks that support ends of the bridge in the runs.

Ball joint suspensions for skewing crane bridges have at least two serious disadvantages, though. Ball joints must be carefully maintained so that they do not fail under load. Ball joints also allow freedom of movement in undesired directions that makes overhead bridge cranes wobbly and unstable.

I have devised an articulating bridge suspension system that improves over the shortcomings of ball joint suspensions. My suspension system ruggedly and reliably accommodates the necessary freedoms of movement without making a bridge crane wobbly or unstable. It also reduces the maintenance required for a bridge crane suspension system, to keep overall costs to a minimum.

SUMMARY OF THE INVENTION

My articulating suspension system accommodates the movements necessary for skewing the bridge of a bridge crane from perpendicular to its runs. This is done by pivoting the runs on axes parallel with and positioned above the runs so that lower regions of the runs carrying end trucks can move toward each other as the bridge skews. The end trucks have dependent hangers movable on pivot axes parallel with the runs, and the hangers have thrust bearing pivots suspended below the end trucks, allowing the bridge to be skewed from perpendicular to the runs and the trucks. End regions of the bridge are dependently supported below the thrust bearings on a pivot axis parallel with and above the bridge. The pivot axes for the bridge, the hangers, and the runs are preferably formed of pivot pins, allowing only the necessary pivot motions, to reduce wobbling of the crane.

DRAWINGS

DETAILED DESCRIPTION

Figure 1:
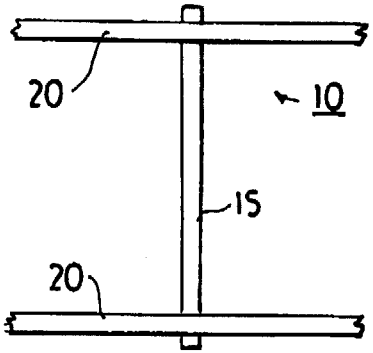
FIG. 1 is a schematic plan view of an overhead crane bridge suspended between a pair of parallel runs.

An overhead bridge crane 10, as schematically illustrated in the plan view of FIG. 1, includes a bridge 15 extending transversely between a pair of parallel runs 20. End trucks roll along the length of runs 20 and support the ends of bridge 15, which is normally perpendicular to runs 20.

Figure 2:
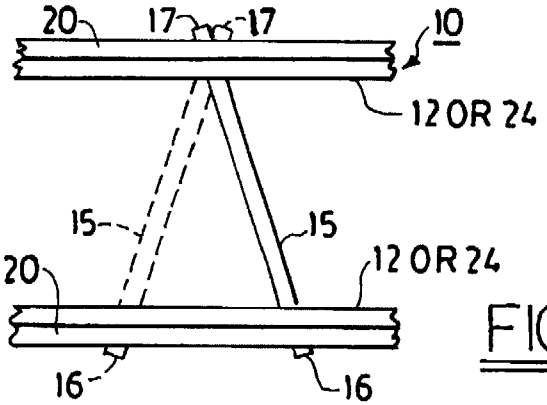
FIG. 2 is a schematic plan view, similar to the view of FIG. 1, and showing movement of the bridge to a skewed position departing from perpendicular to the runs.

An articulating suspension system for bridge crane 10, as schematically shown in the plan view of FIG. 2, allows bridge 15 to be skewed at angles that depart from perpendicular to runs 20. An end 16 of bridge 15 can move between the solid and broken line positions in FIG. 2, for example, so that a load suspended near bridge end 16 can be moved a short distance without moving opposite end 17 of bridge 15. This minimizes the manual effort involved in moving such a load, because it saves the operator from moving the whole bridge 15. Either end of bridge 15 can be used this way, and the resulting reduction in manual effort is significant enough so that an articulating bridge suspension is a feature valuable to purchasers of overhead bridge cranes.

Figure 4:
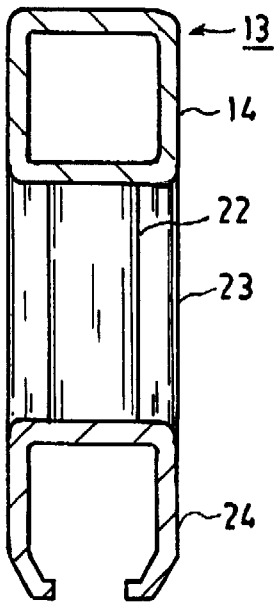
FIG. 4 is an end view of a truss type of beam usable for the bridge and the runs of an overhead crane.
Figure 3:
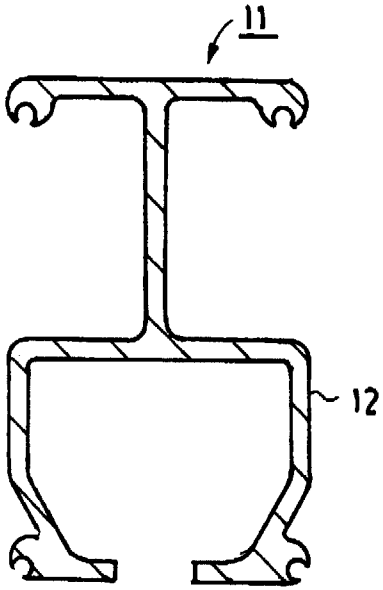
FIG. 3 is an end view of an extruded form of beam usable for the bridge and the runs of an overhead crane.

FIGS. 3 and 4 show two of the many possibilities for beams used in bridges and runs of bridge cranes. Beam 11 of FIG. 3 is extruded, preferably of an aluminum alloy, to include a channel 12 along which an end truck or trolley can run. FIG. 4 shows a truss 13 having an upper box beam 14 and a lower channel 24 interconnected by vertical uprights 22 and 23. End trucks or trolleys can run along channel 24, which is supported by other elements of truss 13. It is also possible to use a channel 24 independently of any supporting truss, and many other variations of beams and trusses are possible for the bridges and runs of overhead cranes.

FIGS. 5–8, which show preferred alternatives for an articulating suspension system, illustrate use of runs 20 and bridges 15 in the form of beams 11. Trusses 13, channels 24, and all the other available variations in beams and trusses for overhead cranes can be substituted for beams 11.

Figure 6:
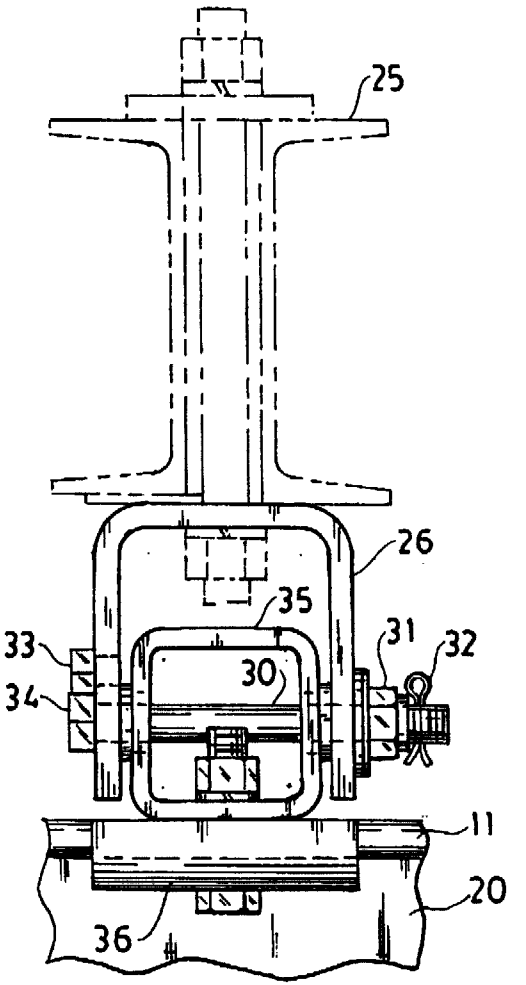
FIG. 6 is a fragmentary side view of the run pivot of FIG. 5.
Figure 5:
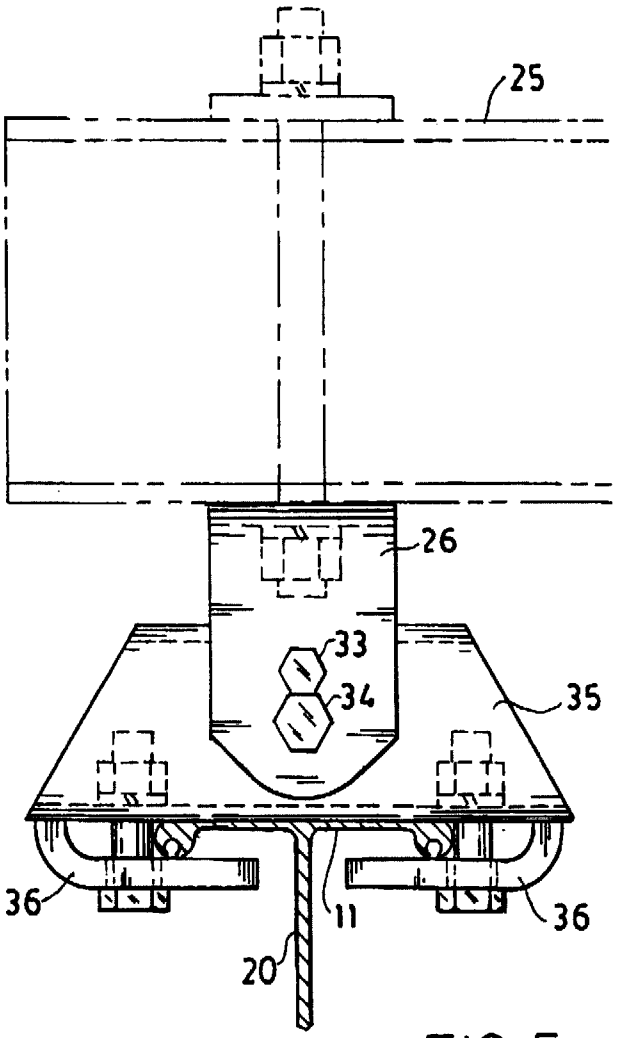
FIG. 5 is a partially schematic, fragmentary end view of a pivot for a run of the crane of FIG. 2.
Figure 8:
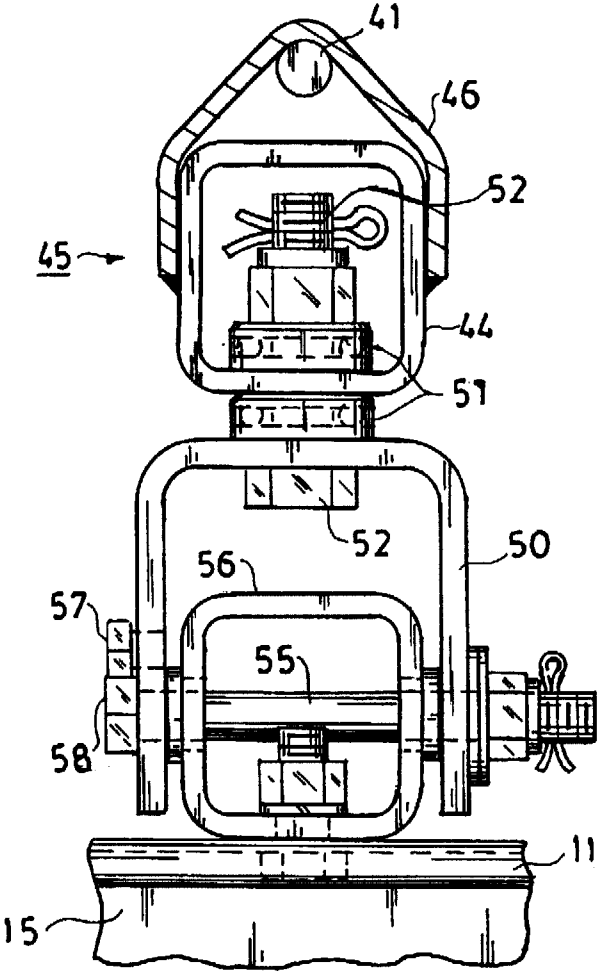
FIG. 8 is a fragmentary side view of the hanger bracket of FIG. 7.

For bridge 15 to skew, as shown in FIG. 2, requires that the lower regions of runs 20 be free to move toward each other, since the angling of bridge 15 from perpendicular to runs 20 effectively shortens the distance between the lower regions 12 of runs 20. Runs 20 must be allowed to pivot toward each other to accomplish this, and FIGS. 5 and 6 show a preferred embodiment of a run pivot support to accomplish this.

Positioned along the lengths of runs 20 are supports 25 having any suitably strong configuration. Supports 25 uphold devises 26 that support pivot pins 30, which are arranged on a single common axis above and parallel with each run 20. The pivot axis formed by two or more pins 30 arranged above runs 20 allows the runs to pivot inward as is necessary for skewing a bridge, but otherwise be restrained from movement. The support provided by pivot pins 30 does not allow runs 20 to move longitudinally or shift a longitudinal angular position so that runs 20, although free to pivot inward toward each other, are otherwise stable and free of wobbling.

Pivot pins 30 are preferably locked against rotation so that a simple nut 31 safeguarded by a cotter pin 32 can hold each pivot pin 30 securely in place. A simple way of providing such a lock is to thread a hex head screw 33 into clevis 26 to engage a hex head 34 of pivot bolt 30, to keep pin 30 from rotating.

A run support bracket 35 mounts pivotally on each pin 30 and includes clamps 36 supporting the run 20. As previously explained, the runs can have several different configurations known in overhead bridge crane art and are not limited to the extruded beam 11 illustrated in FIGS. 5 and 6.

Figure 7:
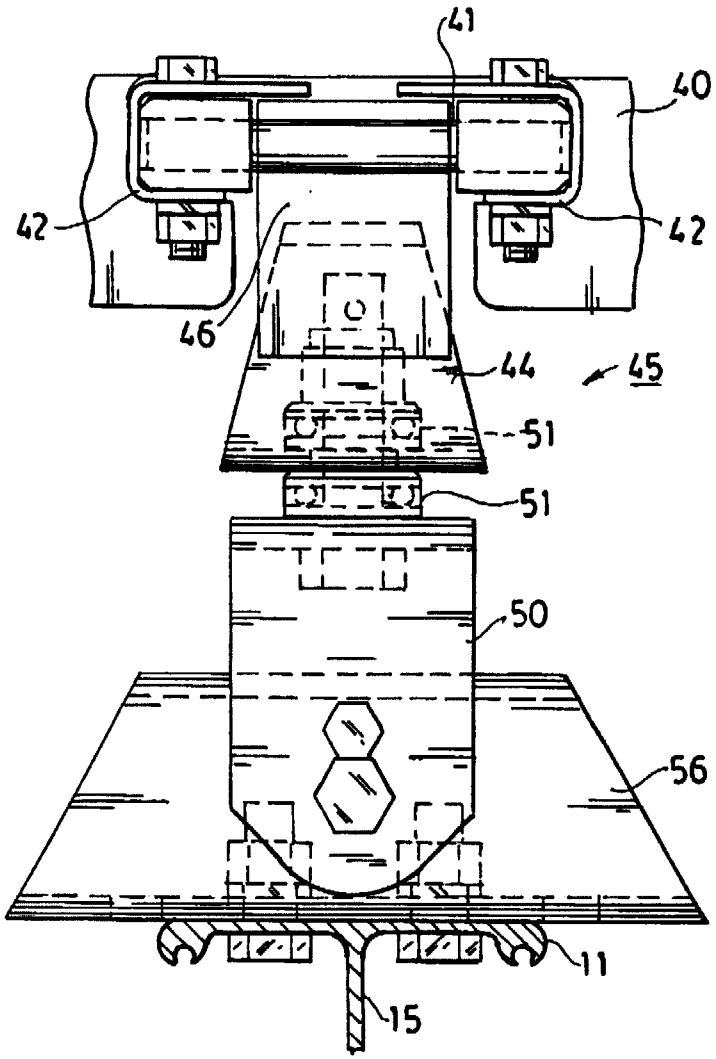
FIG. 7 is a partially schematic, fragmentary end view of a bridge hanger bracket for the crane of FIG. 2.

A fragment of an end truck 40, shown in FIG. 7, supports a hanger 45 for a bridge 15 of an overhead crane. End trucks 40 run along the length of runs 20 and support end regions of a bridge 15 by the hangers 45 shown in FIGS. 7 and 8.

An end truck or hanger pivot pin 41 is supported on each end truck 40, preferably by clamps 42 that lock pin 41 firmly in place and prevent its rotation. Pin 41 then provides a pivot axis parallel with a run supporting end truck 40, and pivot axis 41 provides a pivoting suspension for hanger 45. An element 46 pivotally suspended from pin 41 supports a bracket 44 and a clevis 50. These are interconnected by a thrust bearing 51 that is arranged on a bolt 52 interconnecting bracket 44 and clevis 50. Thrust bearing 51, which can be formed in various ways, allows clevis 50 to pivot around the axis of bolt 52. Since bolt 52 extends generally vertically, clevis 50 is free to pivot horizontally, which accommodates the skewing motion of bridge 15.

When runs 20 are pivoted inward to accommodate bridge skewing, end trucks 40 also pivot inward along with runs 20. Elements 46, which are pivotally suspended from end truck pivots 41, can remain approximately vertical in response to the suspended load, enough though end trucks 40 have inclined somewhat.

Clevis 50 supports a pivot pin 55 on which bracket 56 is pivotally suspended. Bridge 15 is bolted or clamped to bracket 56, which can be done in various ways that depend partially upon the structure of the bridge beam. Pivot pins 55 are on a common axis above and parallel with bridge 15 and are arranged at opposite end regions of bridge 15, which is freely suspended from pivots 55. This allows bridge 15 to hang freely downward from the pivot axis provided by pins 55, even though hanger brackets 45 may be inclined somewhat in response to the load they suspend.

Pivot pins 55 are preferably formed as bolts that are locked against pivoting in the same way as previously described for pivot bolts 30. This involves hex head screws 57 blocking rotation of the hex head 58 of pivot bolt 55. Many other expedients can be used for locking pivot pins 55 against rotation.

The preferred embodiment of an articulating suspension system as described allows the necessary freedoms of movement for skewing bridge 15 from perpendicular to runs 20. At the same time, the preferred system inhibits movements in other directions so that an overhead bridge crane is not made wobbly or unstable. The preferred suspension system is also inexpensive to make and assemble and is ruggedly and reliably structured to require little maintenance during its operating life.

I claim:

1. An articulating suspension of a bridge from a pair of parallel runs of an overhead bridge crane, the suspension comprising:

a. end regions of the bridge being connected to respective bridge hangers by bridge pivot pins;

b. the bridge pivot pins being arranged on a common axis above and parallel with the bridge so that the bridge is dependent from the bridge pivot pins;

c. each of the bridge pivot pins being supported by a hanger clevis that is rotationally mounted on a thrust bearing, giving the bridge freedom to move to positions departing from perpendicular to the runs;

d. the hanger thrust bearings being dependently supported from end truck pivot pins arranged on axes parallel with the runs and carried by end trucks that are movable along the runs; and e. each of the runs being dependently supported from run pivot pins arranged on a common axis parallel with the run and mounted above the run.

2. The suspension of claim 1 wherein bridge supports are mounted on the bridge pivot pins, and end regions of the bridge are clamped to the bridge supports.

3. The suspension of claim 1 wherein the hanger thrust bearings are arranged around a bolt connecting the devises to hanger elements dependent from the truck pivot pins.

4. The suspension of claim 1 including locks preventing rotation of the bridge pivot pins.

5. The suspension of claim 1 including locks preventing rotation of the run pivot pins.

6. The suspension of claim 1 including locks preventing rotation of the end truck pivot pins.

7. A suspension system for a bridge of a bridge crane, the suspension system allowing the bridge to be positioned at angles that depart from perpendicular to bridge crane runs that support ends of the bridge, the suspension system comprising:

a. the runs for the bridge being suspended from a plurality of run pivot pins arranged on a single axis above and parallel with a truck channel of the run;

b. a suspension hanger for each end of the bridge being supported on a hanger pivot pin parallel with the truck channel of a respective one of the runs and supported on an end truck of the bridge running in the truck channel;

c. each of the hangers having a thrust bearing pivot suspended below the hanger pivot pin;

d. each of the thrust bearings supporting a dependent clevis that is rotatable around the axis of the thrust bearing to allow the bridge to be skewed from perpendicular to the runs; and e. each of the dependent clevises carrying a bridge pin supporting an end of the bridge for pivoting dependently on an axis parallel with the bridge.

8. The system of claim 7 including a bridge support mounted on the bridge pivot pin and clamped to an end of the bridge.

9. The system of claim 7 wherein the trust bearing is carried by a bolt connecting the clevis to a portion of the hanger supported by the end truck.

10. The system of claim 7 including locks preventing rotation of the pivot pins.

11. A system for suspending a bridge between the runs of a bridge crane so that the bridge can be positioned at angles departing from perpendicular to the runs, the system comprising:

a. the runs being respectively dependent from pivot axes parallel with and positioned above the runs so that lower regions of the runs can move toward each other;

b. end trucks running in the runs for supporting end regions of the bridge having dependent hangers movable on pivot axes parallel with the runs;

c. the hangers having thrust bearing pivots suspended below the end trucks for allowing the bridge to be skewed from perpendicular to the runs; and d. end regions of the bridge being dependently supported below the thrust bearings on a pivot axis parallel with and above the bridge.

12. The system of claim 11 wherein the pivot axes for the runs are formed as a plurality of pivot pins arranged on a common axis above and parallel with each respective run.

13. The system of claim 11 wherein the hanger pivots are formed as pivot pins carried on the end trucks.

14. The system of claim 11 wherein the thrust bearings are arranged on bolts connecting the bridge supports with the end trucks.

15. The system of claim 11 wherein the dependent support for the bridge is formed of a pair of pivot pins.

16. The system of claim 15 wherein the bridge supports comprise devises suspended from the thrust bearings.

17. The system of claim 16 wherein the bridge pivots include bridge supports mounted on the pivots and clamped to end regions of the bridge.

18. The system of claim 11 wherein the run pivot axes, the hanger pivot axes, and the dependent support for the bridge are all formed as pivot pins.

19. The system of claim 18 including locks preventing rotation of the pivot pins.

* * * * *